United States Patent [19]

Carnicella

[11] Patent Number: 4,774,728

[45] Date of Patent: Oct. 4, 1988

[54] GARMENT CUSTOMIZING METHOD AND APPARATUS

[76] Inventor: Ronald F. Carnicella, 417 N. Beech St., Ebensburg, Pa. 15931

[21] Appl. No.: 777,030

[22] Filed: Sep. 17, 1985

[51] Int. Cl.[4] ..... D05B 25/00

[52] U.S. Cl. ..... 2/243 R; 112/454; 112/155

[58] Field of Search ..... 112/121.11, 121.13, 112/154, 155, 453, 454, 457, 458, 78, 84, 86, 439, 266.1; 2/243 R

[56] References Cited

U.S. PATENT DOCUMENTS

| | | | |
|---|---|---|---|
| 3,816,211 | 6/1974 | Haigh | 112/439 X |
| 4,103,634 | 8/1978 | Schachter | 112/439 |
| 4,208,975 | 6/1980 | Teetz | 112/86 |
| 4,295,433 | 10/1981 | Desprez et al. | 112/155 X |
| 4,362,114 | 12/1982 | Bolldorf | 112/155 X |
| 4,366,763 | 1/1983 | Teetz et al. | 112/155 X |
| 4,517,910 | 5/1985 | Jalowsky | 112/266.1 X |
| 4,557,207 | 12/1985 | Turner et al. | 112/454 X |

OTHER PUBLICATIONS

Promotional Literature "BARUDAN, Barudan Introduces the New BEJRC".

*Primary Examiner*—Louis K. Rimrodt
*Assistant Examiner*—J. L. Olds
*Attorney, Agent, or Firm*—Arnold B. Silverman

[57] ABSTRACT

A method of customizing fabric garments includes employing an embroidery machine to create a master design at a plurality of locations on said fabric and subsequently automatically applying a custom design sequentially in the general region of the master designs. In one embodiment, the master design containing fabric portions are severed into individual patches which are subsequently provided with the custom design. The patches may then be secured to an article of clothing as by adhesive means or other suitable means. The apparatus for effecting customizing includes embroidery apparatus which apply a plurality of master designs and computerized monogram apparatus for sequentially applying a custom design to the region of the master designs.

9 Claims, 1 Drawing Sheet

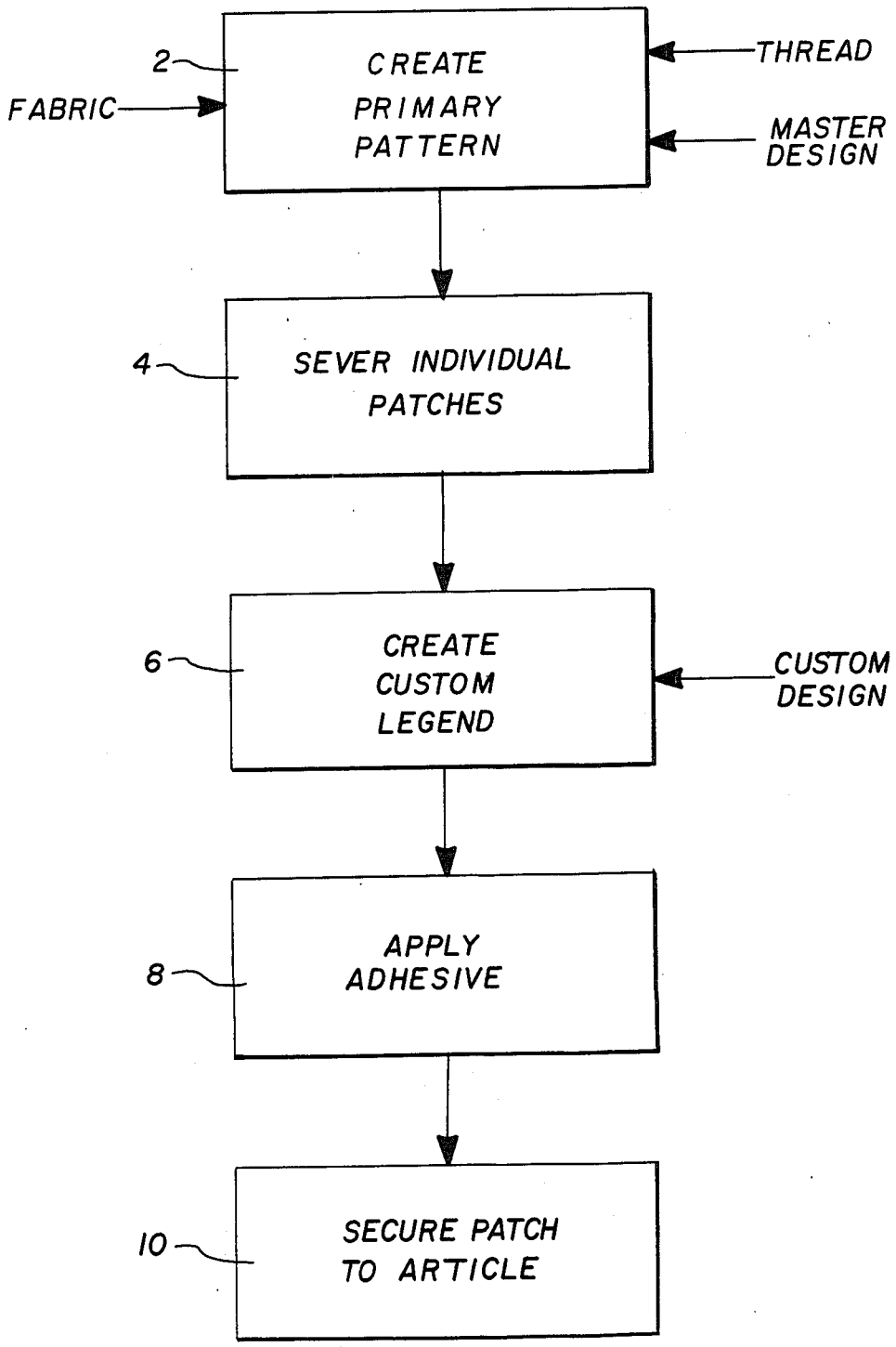
2
FABRIC
CREATE PRIMARY PATTERN
THREAD
MASTER DESIGN
4
SEVER INDIVIDUAL PATCHES
6
CREATE CUSTOM LEGEND
CUSTOM DESIGN
8
APPLY ADHESIVE
10
SECURE PATCH TO ARTICLE

GARMENT CUSTOMIZING METHOD AND APPARATUS

BACKGROUND OF THE INVENTION

1. Field of the Invention

This invention relates to an improved method and associated apparatus for creating a plurality of customized garments which have both a master design and custom design.

2. Description of the Prior Art

It has been known to employ various types of decorative and informational insignias and monograms on various articles of clothing. It is common to find caps, shirts, sweaters and jackets bearing team designations, company designations, and identification of individuals. One common method of applying these indicia have been by means of patches which may be sewn on or adhesively secured.

It has been relatively easy and economically advantageous to generate a plurality of such decorative indicia for a particular team. As a result of the need for individual custom work, it has not been practical to provide large numbers of garments decorated with both the team indicia and a custom indiator such as an individual's identification provided in close proximity thereto, whether applied by patch or by other means.

SUMMARY OF THE INVENTION

The present invention has met the above-described need by permitting a large number of master designs such as a team designation to be applied simultaneously to one or more pieces of fabric and for each of them to receive a customized design such as an individual's name, nickname or other identifying characteristic such as a uniform number, for example.

The method of the present invention provides for the use of an embroidery machine to simultaneously generate a plurality of master designs on a piece of fabric or a number of garments. Subsequently, the individual custom designs are automatically applied sequentially.

In one preferred approach of the invention after the plurality of master designs are applied, the primary fabric is segmented into a plurality of patches containing the master designs. The individual patches are then provided with the custom design as by a computerized monogramming machine. The patches may then be secured to the desired garment such as a cap, for example, at a predetermined position by adhesive means or other suitable means.

The apparatus of the present invention provides means for simultaneously applying a master design to fabric and computerized means for applying customized designs at or adjacent to the location of the master design.

It is an object of the present invention to provide a rapid and economic method and apparatus for applying the combination of master designs and customized designs to fabrics.

It is a further object of the present invention to provide such a method and associated apparatus which will permit relatively small patches to be provided with both the master design and customized design in an economically advantageous and aesthetically appealing manner.

It is yet another object of the present invention to provide such a method and apparatus which may readily be employed in either making patches or applying the designs directly to articles of clothing These and other objects of the invention will be more fully understood from the following description of the invention on reference to the illustration appended hereto.

BRIEF DESCRIPTION OF THE DRAWING

The drawing illustrates a process sequence for a preferred embodiment of the invention.

DESCRIPTION OF THE PREFERRED EMBODIMENT

In order to be advantageous from aesthetic, economical and time efficiency standpoints, the manufacture of (a) patches for application to garments and (b) garments directly decorated having both a master design and a custom design, the present invention employs a unique method and apparatus.

Referring to the Figure, a general overview of a preferred embodiment of the invention will be considered. Considering first an embodiment wherein patches will be made and secured to an article of clothing, a piece of fabric such as tackle-twill and the desired thread of contrasting color for decorating the fabric are provided on a suitable embroidery machine. The machine has the capability of applying a master design substantially simultaneously to a number of areas of the fabric. The master design is preferably provided to the machine on a computerized media, such as tape. Assuming that the machine has twelve heads, for example, the machine may simultaneously apply twelve master designs in relative spaced relationship with respect to each other on the single piece of fabric. By way of example, one might consider a patch on which it is desired to provide a graphic representation of a football and the team designation "Blue Devils" within the border of the football. All of this may be embraced within the master design as each patch would contain this common feature. The custom design may then provide the name or nickname of an individual player and, if desired, the number which appears on his uniform jersey. For example, underlying the team designation "Blue Devils" there may appear the name "Chris" and under that the number "26". The customized design portion may be provided in the manner described hereinafter.

A suitable embroidery machine for use in the present invention is that sold under the trade designation Barudan BEJRC-UF 12 or BEHMJ-UF-24 as marketed by MacPherson, Inc. of Greensboro, N.C.

After the master design has been applied, the fabric is removed, the individual patches are severed from the parent fabric and appropriate protective and decorative borders may be sewn therearound. A suitable piece of equipment for accomplishing this objective is the Merrow machine M-3 DW as marketed by Pennsylvania Sewing Machine, Inc. of Pittsburgh, Pa.

After the sequentially produced master design bearing patches have been severed, the customized design e.g. "Chris 26" is applied, preferably by means of a computerized monogram machine. Such machines permit the operator to input by keyboard the specific customized information desired to be provided by the equipment. The patches would be placed in an appropriate securing bracket for retention while the monogramming machine applies the custom design. A suitable retaining device for the patch while the custom design is being applied is that marketed under the trade designation Meistergram Insta-Patch Hoop.) The patches are provided with the custom design on an individual basis sequentially. A suitable piece of equipment for applying the custom design is the apparatus sold under the trade designation Meistergram M600 XL which is marketed by Meistergram, Inc. of Cleveland, Ohio.

It will be appreciated that the method and associated apparatus provides for the efficiency, speed and economic advantages of automated manufacture while permitting customizing of a master design.

The patch is complete at this point and may be secured to the garment by any desired means. The preferred means of accomplishing this will be considered. The patch is placed in a preparation tray and is moistened with a liquid such as water, for example, at room temperature. A powdered adhesive is then applied to the wet rear surface of the patch. It is preferred that the adhesive be sprinkled on the wet surface as a dry powder. A suitable adhesive for this purpose is that sold under the trade designation DUMMY DUST by Natmar although other suitable adhesives will be known to those skilled in the art. The patches are then secured in a suitable dryer at approximately 1000° F. This is preferably accomplished by means of a dryer which transports the adhesive bearing patches through the dryer on a conveyor belt. Within about 10 to 20 seconds the adhesive and liquid are dry. A suitable dryer for such purposes is that marketed under the designation Americana Tex Air 30 Textile Dryer. The glue powder may be dispensed onto the wetted surface of the patch by any suitable dispenser.

The cured adhesive bearing patch is then placed on the garment to which it will be secured and a press applies pressure, preferably at an elevated temperature in order to complete the securement process. For example, if the patch were to be placed on the front of a cap such as a baseball cap, the press may apply pressure at a temperature of about 400° F. for about 15 seconds. Thereafter, if desired, in a separate press, pressure may be applied at room temperature for about 10 to 15 seconds in order to assure good bonding between the patch and the cap. A suitable press for use with caps is that sold under the trade designation Hix VH-250 Hat Press by Advanced Process & Supply, Inc. of Chicago, Ill.

While reference has been made herein to securement of patches by adhesive it will be appreciated that patches may be secured by other means such as sewing. Also, the master and custom dsigns may be applied directly to the fabric or garment without the use of patches, if desired.

While for convenience of reference herein, disclosure has been made of the use of the method and apparatus of the invention in providing patches for application to caps, it will be appreciated that the invention may be employed to create patches to be applied to other articles of clothing, such as hats, shirts, sweaters, jackets for example. The invention may also be employed to provide the master design and custom design directly on the article of clothing.

As the methods of programming computerized embroidery and monogramming machines are well known to those skilled in the art, details need not be provided herein.

It will be appreciated, therefore, that the present invention provides efficient, automated, rapid and economical means for applying both a master design and a custom design to decorate an article of clothing or a patch for application to the same. All of this is accomplished in a manner which permits the master design to be a team designation either graphically or in words or both and the custom design to be an individual's designation by name or number, for example, or such other combinations of master and custom designs as one desires.

Whereas particular embodiments of the invention have been described above for purposes of illustration, it will be evident to those skilled in the art that numerous variations of the details may be made without departing from the invention as defined in the appended claims.

I claim:

1. A method of customizing patches comprising
providing a fabric article, an embroidery machine and a computer controlled monogramming machine,
simultaneously creating a master design at a plurality of locations on said fabric article to create a plurality of individual master design bearing elements by means of said embroidery machine,
severing said individual master design bearing elements from said fabric article to create a plurality of patches, and
subsequently sequentially automatically applying a custom design in the general region of said master designs on said patches.

2. The customizing method of claim 1 including
individually applying said custom design to each said patch, and
subsequently securing said patch to an article of clothing.

3. The customizing method of claim 2 including
prior to securing said patches to articles of clothing establishing borders on said patches.

4. The customizing method of claim 2 including
securing said patches to said articles of clothing by adhesive means.

5. The customizing method of claim 4 including
employing a cap as said article of clothing.

6. The customizing method of claim 5 including
subsequent to applying said custom design moistening the rear surface of said patch,
applying dry adhesive to said moistened patch surface, and
curing said adhesive containing surface at an elevated temperature.

7. The customizing method of claim 6 including
subsequent to curing said adhesive applying said patch to said article under pressure.

8. The customizing method of claim 7 including
establishing said master design as a team identification, and
establishing said custom design as identification of an individual.

9. A methd of creating a customized design on a plurality of articles of clothing comprising
providing a plurality of articles of clothing, an embrodiery machine and a computer controlled monogramming machine,
creating a master design on each said article of clothing by means of said emboridery machine, and
subsequently sequentially automatically applying a custom design in the general region of said master design on each said article of clothing.

* * * * *

UNITED STATES PATENT AND TRADEMARK OFFICE

CERTIFICATE OF CORRECTION

PATENT NO. : 4,774,728

DATED : October 4, 1988

INVENTOR(S) : RONALD F. CARNICELLA

It is certified that error appears in the above-identified patent and that said Letters Patent is hereby corrected as shown below:

Column 1, line 26, "indiator" should be --indicator--.

Column 3, line 49, "dsigns" should be --designs--.

Claim 9, column 4, line 57, "methd" should be --method--.

Claim 9, column 4, lines 59-60, "embrodiery" should be --embroidery--.

Claim 9, column 4, line 63, "emboridery" should be --embroidery--.

Signed and Sealed this

Eighteenth Day of April, 1989

*Attest:*

DONALD J. QUIGG

*Attesting Officer*

*Commissioner of Patents and Trademarks*